United States Patent [19]

Nuss

[11] 3,939,817

[45] Feb. 24, 1976

[54] OVEN DOOR HANDLE CONSTRUCTION

[75] Inventor: James J. Nuss, Louisville, Ky.

[73] Assignee: General Electric Company, Louisville, Ky.

[22] Filed: Dec. 6, 1974

[21] Appl. No.: 530,072

[52] U.S. Cl. ..... 126/190; 126/200

[51] Int. Cl.[2] ..... F23M 7/00

[58] Field of Search ..... 126/190, 193, 198, 200

[56] References Cited

UNITED STATES PATENTS

| | | | |
|---|---|---|---|
| 3,439,669 | 4/1969 | Winkler | 126/200 |
| 3,710,776 | 1/1973 | Frick | 126/200 |

*Primary Examiner*—Kenneth W. Sprague
*Assistant Examiner*—Larry I. Schwartz

[57] ABSTRACT

An oven door of sheet metal construction having cooling air channels which allow room air to pass up through the door. An elongated door handle is mounted across the top portion of the front face of the door. The handle has a base portion attached to the door and an elevated gripping portion extending above the top edge of the door and spaced away from the door by a plurality of spaced strut members to allow cooling air to pass up behind the gripping portion. The elevated gripping portion serves as both an upward hot air deflector and as a shielding means to prevent touching areas adjacent the top edge of the door.

3 Claims, 4 Drawing Figures

OVEN DOOR HANDLE CONSTRUCTION

CROSS-REFERENCE TO RELATED APPLICATION

A related design of ventilated oven door cooperating with an exhaust nozzle of an exterior oven cooling system is described in a copending patent application of the present inventor filed July 31, 1974, Ser. No. 493,332, now U.S. Pat. No. 3,889,099, entitled "Oven Door Cooling System." This earlier ventilated oven door design has a standard door handle below the top edge of the door, while the above-mentioned exhaust nozzle serves as an aspirator for the cooling air passing up through the door.

BACKGROUND OF THE INVENTION

1. Field of the Invention:

The invention relates to a ventilated oven door construction, and particularly to an elevated door handle which serves as both a hot air deflector and a shielding means.

2. Description of the Prior Art:

A ventilated oven door with a cooling air channel behind the outer door panel so that currents of cooling air may pass up through the air channel is described in the patent of James A. White, U.S. Pat. No. 3,736,916, which is also assigned to the assignee of the present invention. This patent shows another example of a simple oven door handle located below the top edge of the door.

Another such ventilated oven door with a different kind of simple oven door handle is shown in a second patent of James A. White, U.S. Pat. No. 3,760,792 of the present assignee. This door handle is also located below the top edge of the door.

One problem experienced with ventilated oven doors is that high operating temperatures are likely to appear along the top edge of the door, the area directly above the door, and the door handle. Ventilated doors are used most often with pyrolytic self-cleaning ovens, where the internal oven temperatures rise to a maximum temperature of about 950°F during the automatic cleaning of the food soils and grease spatter from the walls forming the oven cooking cavity.

The allowable surface temperatures permitted by the Underwriters' Laboratories, Inc. for range components mounted above 36 inches from the floor is 182°F for bare or painted metal, 190°F for porcelain enamel finishes, 202°F for glass and 212°F for plastics. Allowable surface temperatures for handles and knobs is about 50°F less than the above temperatures for the same materials.

A principal object of the present invention is to provide a ventilated oven door with an elevated door handle extending above the top edge of the door to serve as both a hot air deflecting means and a shielding means.

A further object of the present invention is to provide an oven door construction with a door handle of the class described for reducing as well as preventing access to the areas of maximum outer surface temperatures adjacent the top edge of the door.

SUMMARY OF THE INVENTION

The present invention, in accordance with one form thereof, relates to a ventilated door of a high temperature oven, where cooling air is allowed to pass up through the door and exit adjacent the top edge of the door. An elongated door handle has attaching means for fastening the handle to the door adjacent the top portion of the front face of the door. The handle also includes an elevated gripping means spaced away from the door and extending above the top edge of the door to serve as both an upward deflector means for the hot air discharging from the top edge of the door as well as a shielding means to prevent touching areas above the door that are at maximum temperatures.

BRIEF DESCRIPTION OF THE DRAWINGS

This invention will be better understood from the following description taken in conjunction with the accompanying drawings and its scope will be pointed out in the appended claims.

DESCRIPTION OF THE PREFERRED EMBODIMENTS

Figure 1:
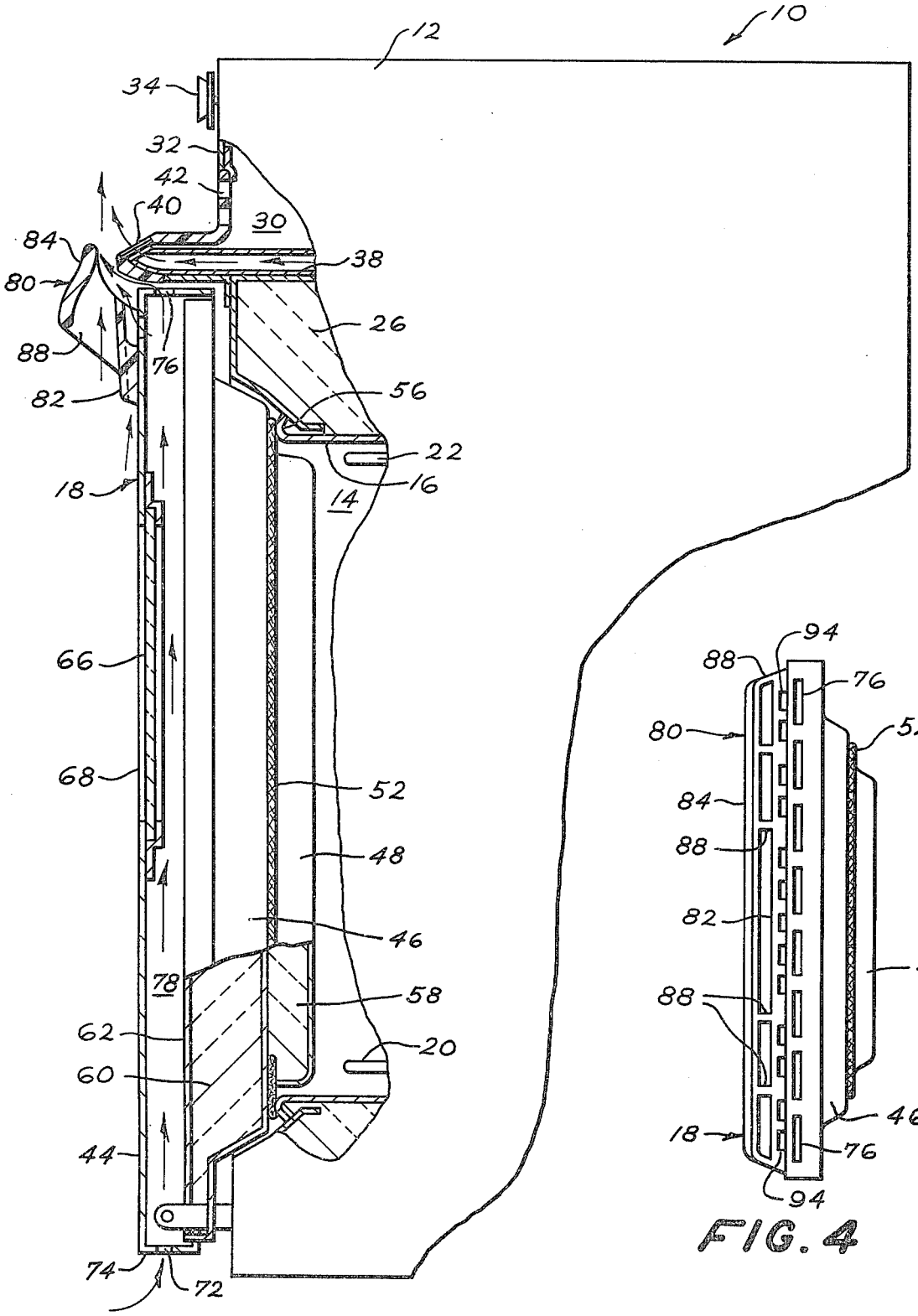
FIG. 1 is a side elevational view of a built-in, electric wall oven that includes a ventilated oven door and elevated door handle of the present invention.

Turning now to a consideration of the drawings, and in particular to FIG. 1, there is shown a built-in, electric wall oven 10 having an outer oven body or cabinet structure 12 which surrounds an oven cooking cavity 14 formed by a box-like oven liner 16 and a front-opening, access door 18. This oven is adapted to be heated by a lower bake element 20 and an upper broil element 22. These heating elements are shown as metal sheathed electrical resistance heating elements. However, it will be understood by those skilled in this art that the door design of the present invention is not limited to use with an electrically heated oven. It could just as well be used with a gas-fired oven without departing from the present invention.

The oven liner 16 is surrounded by a layer of thermal insulation 26 for retarding the escape of heat energy from the oven cavity. Located above the insulated oven liner is a control compartment 30 which is furnished at the front with a control panel 32 which may support a plurality of control components 34 such as an oven selector switch, an oven thermostat, an oven clock-timer, controls for a meat thermometer as well as for an oven rotisserie and the like.

An oven exhaust duct 38 is shown above the insulated oven liner and it extends forwardly beneath the lower portion of the control panel 32, and it has an upwaradly inclined discharge nozzle 40 directed at an angle of about 45°. This exhaust duct 38 would be joined to an oven vent opening (not shown) in the top wall of the oven liner 16. An open grill 42 is shown in the control panel 32 beneath the control components 34. This grill serves as a thermal break, as well as an exhaust vent for an oven cabinet cooling system (not shown) which circulates room air between the insulated oven liner and the oven cabinet 12 and exhausts them through the grill 42 for holding down the exterior oven cabinet temperatures. For more information on an oven cabinet cooling system, see the patent of George A. Scott and James K. Newell, Jr., U.S. Pat. No. 3,310,046, which is also assigned to the present assignee.

As is best seen in FIG. 1, the oven door 18 is of generally sheet metal construction having three main elements: an outer door panel 44, an inner door liner 46 and an inner panel 48 that is adapted to telescope into the throat of the oven liner 16 in the manner of a plug. A resililent thermal gasket 52 such as woven fiber glass is sandwiched between the periphery of the inner panel 48 and the inner door liner 46, and this gasket is adapted to seal against the front flange 56 of the oven liner 16. Thermal insulation 58 is shown within the inner panel 48, and another layer of thermal insulation 60 is within the inner door liner 46. A sheet metal insulation guard 62 serves to hold the layer of insulation 60 in place. A viewing window 66 is shown in the outer door panel 44 in the form of a high temperature glass pane 68. Similar glass panes in a sealed subassembly (not shown) would be mounted within the inner door liner 46 and the inner panel 48 in order to permit viewing into the oven cooking cavity 14, while retarding heat loss through the window subassembly.

A plurality of air inlet openings 72 are formed in the bottom portion of the rearwardly-turned flange 74 of the outer door panel 44. Similarly, a plurality of air outlet openings 76 are formed in the top portion of the same rearwardly-turned flange 74 of the outer door panel. An air channel 78 is created by the spacing of the insulation guard 62 back from the outer door panel 44. Thus, relatively cool room air is drawn into the door 18 by way of the air inlet openings 72. This cooling air stream rises through the door and is able to pick up some of the heat energy stored in the thermal insulation 60, insulation guard 62 and the sealed window subassembly (not shown). This rising air stream then exits from the door by way of the air outlet openings 76. The temperature of this air stream as measured at the top edge of the door may reach as high as 350°F if this oven is operated on a pyrolytic self-cleaning oven cycle as discussed above. This high temperature tends to overhead the top portion of the door and the overhanging trim.

The present invention relates to means for protecting the user of the oven from touching overheated areas of the oven front in the vicinity of the top edge of the door. The door 18 is furnished with an elongated door handle 80, that is nearly as long as the full width of the door as is seen in the top view of FIG. 4. The door handle may be formed of a high temperature plastic such as a phenolic or it may be a die casting or a mixture of the two materials. The door handles has an attaching portion 82 and an elevated, hand-gripping portion 84 that is spaced away from the attaching portion. The attaching portion 82 is placed flush against the outer door panel 44 at the top edge thereof. It would be held in place by fastening screws (not shown) that are threaded in place from the inner side of the outer door panel. The gripping portion 84 is joined to the attaching portion 82 by a plurality of widely spaced strut members 88 as is best seen in the top view of FIG. 4. The central area of the handle is an open area free of the strut members 88 so as not to interfere with the ease of grasping the hand-gripping portion 84.

Notice that room air is allowed to flow up through the handle 80 in the areas defined between the attaching portion 82 and the gripping portion 84 and the widely spaced strut members 88. This room air mixes with the hot air expelling from the air outlet openings 76 and reduces the temperature thereof. This combined air then mixes with the discharge from the nozzle of the oven exhaust duct 38 to propel it in an upward direction for mixing with the frontward discharge from the grill 40.

Notice also that the gripping portion 84 is elevated above the top edge of the door and above a portion of the discharge nozzle of the oven exhaust duct 38. Thus, the gripping portion 84 serves as an air deflector as well as a shielding means to prevent the fingers from inadvertently reaching the top edge of the door or the front and underside surfaces of the discharge nozzle 40 and the overhanging trim.

Figure 4:
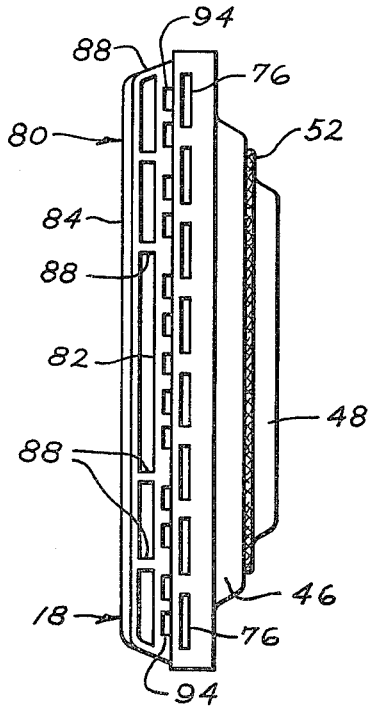
FIG. 4 is a top plan view on a reduced scale of the oven door of the present invention arranged in its vertical closed position.
Figure 2:
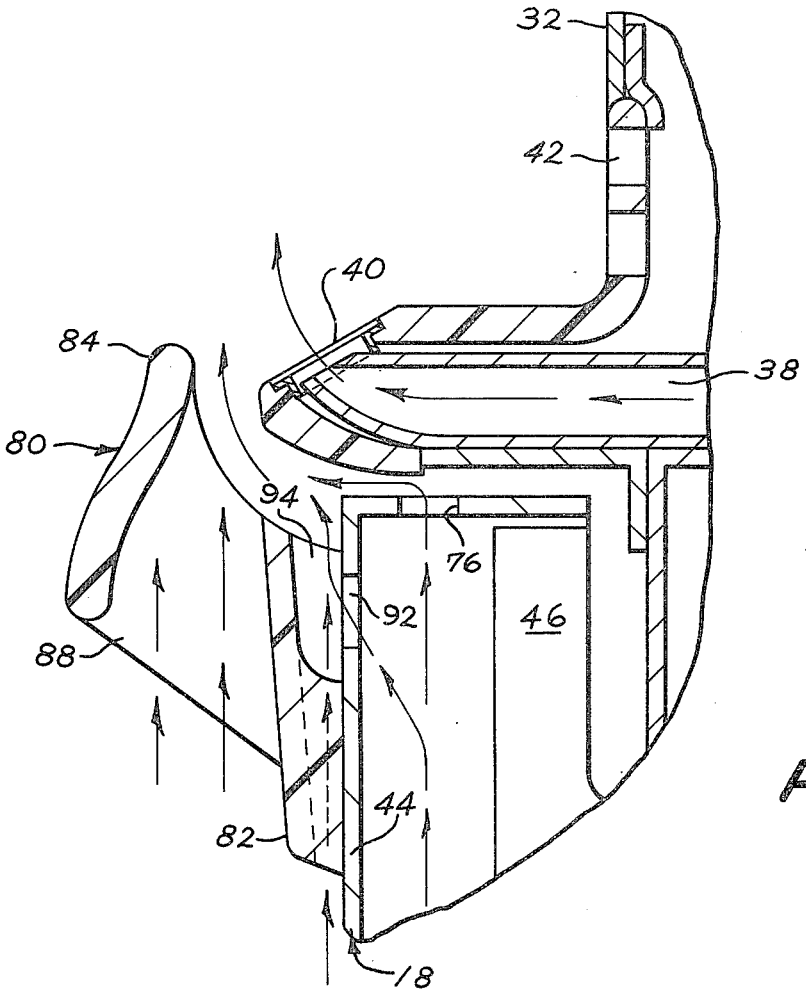
FIG. 2 is an enlarged fragmentary view similar to that of FIG. 1 of the area centered around the upper portion of the door to show the various air flow patterns.

A method of increasing the air flow up through the door is to provide more air outlet openings. Secondary outlet openings 92 are formed in the outer door panel 44 underneath the attaching portion 82. Slots 94 are formed in the attaching portion to communicate with these secondary openings 92 and to be open at the top, as is seen in FIGS. 1, 2 and 4.

Figure 3:
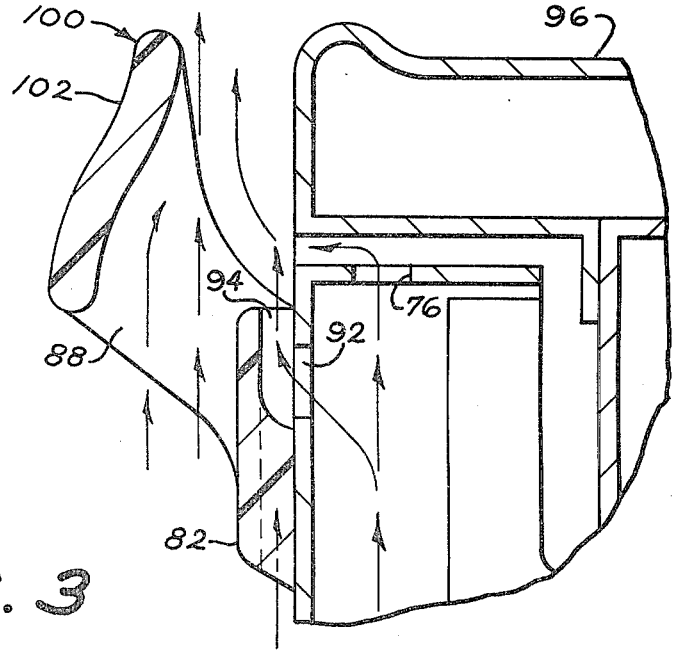
FIG. 3 is an enlarged fragmentary view similar to that of FIG. 2 except the ventilated door of the present invention is shown in use below a cooktop of a range.

FIG. 3 shows a second modification 100 of the door handle of this invention except the ventilated oven door 18 is shown in use below a cooktop 96 of a range. The same elements are identified with the same reference numerals as were used in the first modification. The elevated hand-gripping portion 102 rises higher than the gripping portion 84 of the first modification. This tends to shield the entire front edge of the cooktop 96 and eliminate hot spots which are subject to touch.

Modifications of this invention will occur to those skilled in thio art, therefore, it is to be understood that this invention is not limited to the particular embodiment disclosed but that it is intended to cover all modifications and their equivalents which are within the true spirit and scope of this invention as claimed.

I claim:

1. A door construction for a high temperature oven comprising an outer door panel and a spaced inner door liner that is adapted to be exposed to the high temperatures within the oven, thermal insulating means within the door for retarding the flow of heat from the inner door liner to the outer door panel, and cooling air channel means behind the outer door panel to allow room ambient air to enter the bottom of the door and rise up through the door and exit adjacent the top edge of the door; the invention comprising an elongated door handle having attaching means fastened to the door adjacent the top edge thereof and elevated gripping means spaced away from the door and extending above the top edge of the door, said gripping means also serving as an upward deflector means for the hot air expelling from the door and as a shielding means to prevent ready access to the oven area immediately above the door, wherein the said door handle substantially extends from one side of the door to the other and the door gripping means is spaced away from the said attaching means by a plurality of spaced strut members thereby forming air passages up through the handle so that room air may pass up through the handle and mix with the hot air coming from the oven.

2. A door construction for a high temperature oven as recited in claim 1 wherein the said door handle attaching means is provided with a plurality of cooling air passages to assist in holding down the maximum temperature experienced by the handle.

3. A door construction for a high temperature oven as recited in claim 2 wherein the top portion of the front face of the outer door panel is provided with a plurality of openings communicating with the plurality of cooling air passages in the handle attaching means to increase the flow of room ambient air up through the door.

* * * * *